United States Patent [19]

Schnittker

[11] 4,353,324

[45] Oct. 12, 1982

[54] FENCE PAINTING APPARATUS

[76] Inventor: George Schnittker, 900 E. Roosevelt Rd., Lombard, Ill. 60148

[21] Appl. No.: 172,455

[22] Filed: Jul. 25, 1980

[51] Int. Cl.[3] ..... B05C 1/08

[52] U.S. Cl. ..... 118/207; 118/228; 118/259; 15/21 E; 15/77

[58] Field of Search ..... 118/207, 224, 208, 223, 118/305, 228, 259; 15/21 E, 77

[56] References Cited

U.S. PATENT DOCUMENTS

| | | | |
|---|---|---|---|
| 308,506 | 11/1884 | Marsan | 118/208 |
| 1,333,132 | 3/1920 | Riechers | 118/208 |
| 2,015,768 | 10/1935 | Thompson | 118/208 |
| 2,489,445 | 11/1949 | Benzully | 91/45 |
| 2,543,436 | 2/1951 | Chappen | 91/44 |
| 2,735,128 | 2/1956 | Adams | 118/208 X |
| 2,813,292 | 11/1957 | McLendon | 118/208 X |
| 3,108,301 | 10/1963 | Jones | 15/77 |
| 3,257,989 | 6/1966 | Webb | 118/305 |
| 3,532,070 | 10/1970 | Lamarque | 118/2 |
| 3,611,983 | 10/1971 | Wise | 118/207 X |
| 4,197,998 | 4/1980 | Jolly, Jr. | 239/184 |

FOREIGN PATENT DOCUMENTS

| | | | |
|---|---|---|---|
| 559287 | 2/1975 | Switzerland | 15/21 E |

*Primary Examiner*—John P. McIntosh

*Attorney, Agent, or Firm*—Price, Heneveld, Huizenga & Cooper

[57] ABSTRACT

An apparatus particularly adapted and intended for mounting at the side of a vehicle (but capable of being pushed or pulled along by other means), for mechanized painting of both sides, or only one side, of a fence or wall structure. A yoke assembly carrying one or more pairs of opposite paint rollers straddles the fence, and means are provided to allow the yoke to float longitudinally, vertically and laterally, and according to the average running surface of the terrain, while moving along and painting one or both sides of a fence or wall.

14 Claims, 4 Drawing Figures

FIG. 1
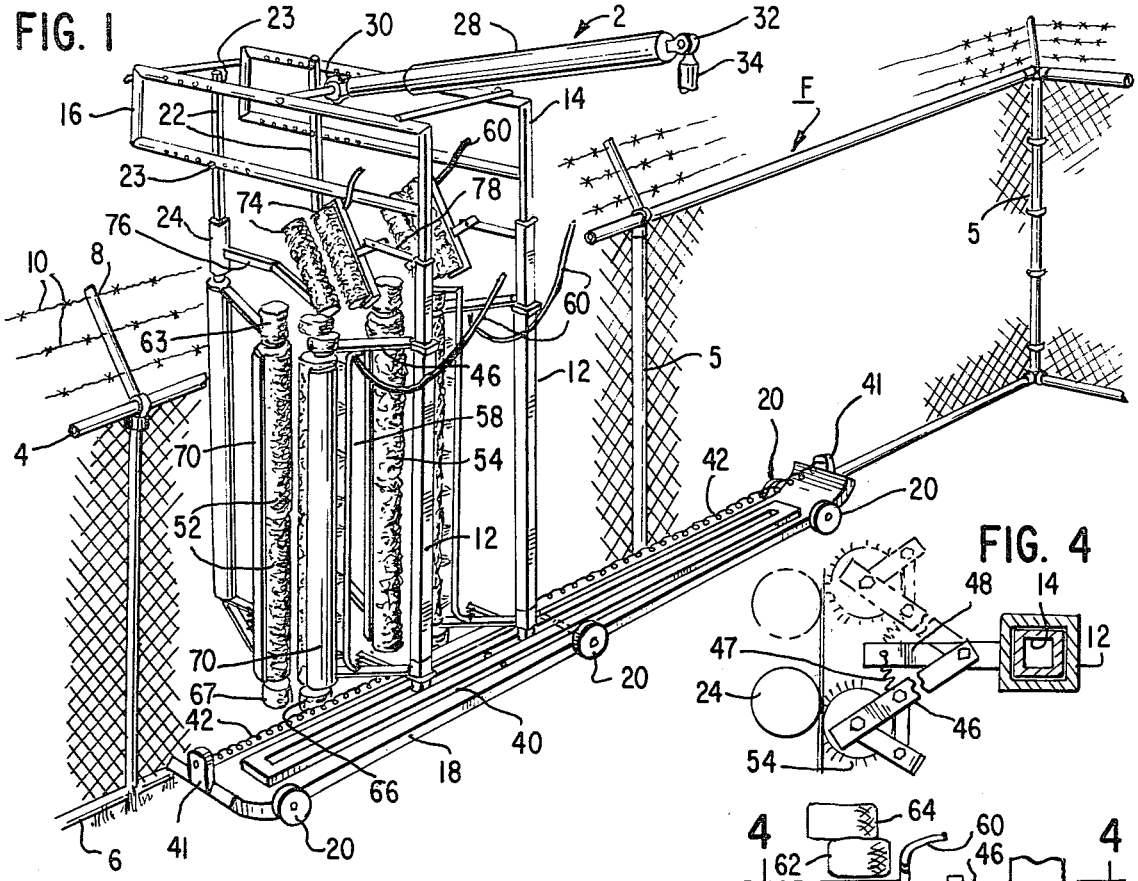
FIG. 4
FIG. 2
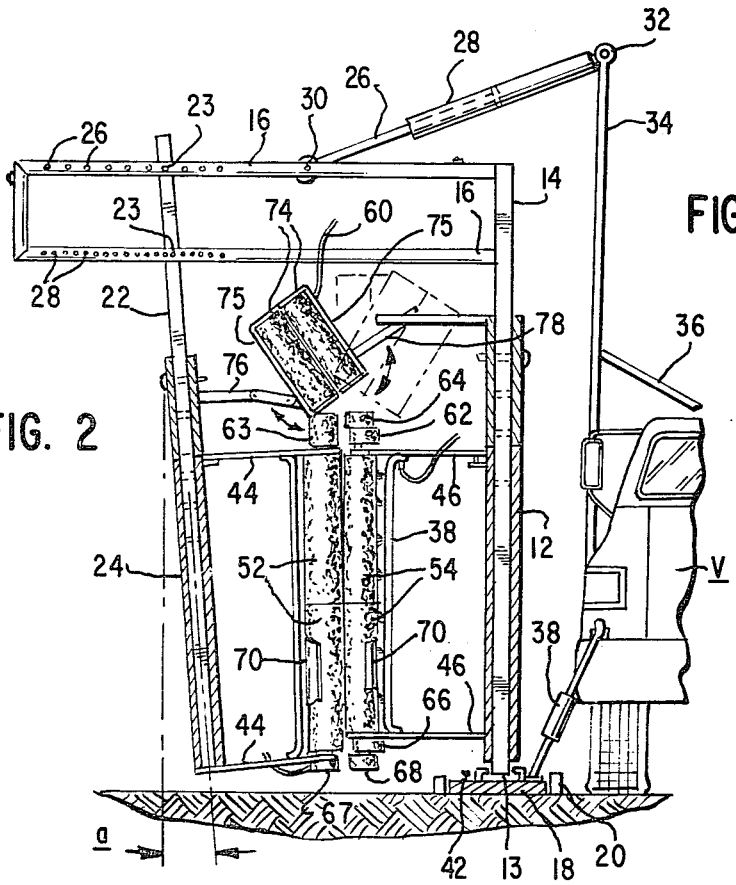
FIG. 3
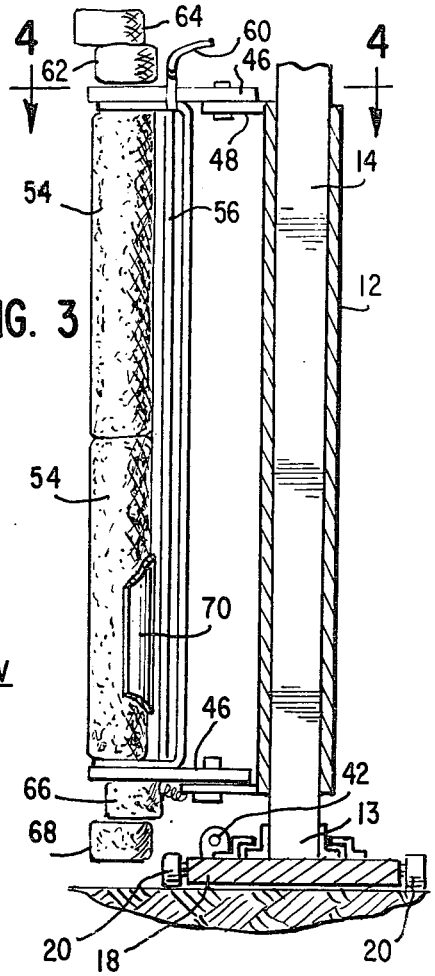

FENCE PAINTING APPARATUS

BACKGROUND OF THE INVENTION

1. Field of the Invention

Painting and/or coating of vertical surfaces, particularly fences and wall structures.

2. Background of the Prior Art

The painting or coating (e.g., with corrosion resistant coatings) has been accomplished mainly by manual labor with brushes or rollers, or by use of spray equipment. For large projects, the cost of manual labor usually is prohibitive, which discourages proper maintenance; spraying processes applicable to such purposes generally are wasteful of paint and pose problems and liability due to airborne scattering of paint. Other problems are that fences and walls to be painted often are ten to twelve feet or more in height, requiring a scaffold or other means to reach them effectively. In the case of security fencing, it is common to have several strands of barbed wire at the top, sometimes oriented at a 30°–45° angle to the vertical posts, and at a height of perhaps eight to twelve feet. Manually applying paint or corrosion-resistant coatings to fences or walls under such circumstances therefore becomes unweildy and uneconomical; in some cases these factors may indeed discourage proper maintenance.

Benzuly U.S. Pat. No. 2,489,445, issued Nov. 29, 1949, discloses a paint spraying apparatus which is supported by sections of track mounted on brackets which must be previously affixed to the top railing of a fence, and therefore inherently requires extensive time-consuming labor and preparation and after-removal.

Webb U.S. Pat. No. 3,257,989 of Jun. 28, 1966 similarly shows a spraying unit which travels on a separate trackwork hooked onto the fencing; it also incorporates booms which must be swung (manually) upwardly and downwardly in order to cover the entire fence area. No means are provided for painting slanted upper sections of barbed wire or the like.

Lamarque U.S. Pat. No. 3,532,070, issued Oct. 6, 1970, discloses opposed spray units mounted on the boom of a vehicle. The vertical and lateral positioning of the spraying assembly is dictated solely by the movement of the vehicle over the adjacent terrain and/or the careful attention of the machine operator to handling the steering and boom controls continuously.

SUMMARY OF THE INVENTION

In accordance with my invention, I provide a piece of apparatus which can be mounted at the side of a truck, tractor or other type of vehicle, or otherwise be pushed or pulled along, to effect the application of decorative paint and/or corrosion-resistant coating either to both sides or one side of a vertical fence or wall. The apparatus "floats", first to accomodate an average level of terrain, and secondly, to accomodate either the deviations in a driver's steering or lateral deviations in the line of the structure being covered. These objects are accomplished by means of a "sled" (extending up to the length of an average pickup truck) which supports a yoke having roller applicator means straddling a fence structure, said yoke and sled having the freedom to adjust themselves to the terrain and fence, irrespective, for example, of minor deviations in the vehicle driver's control of the vehicle.

Other features include a toggle-type structure carrying an upper set of opposed rollers which are adjustable to the angle of barbed wire stretched atop the main vertical fence line. Still another feature comprises a separate set of rollers especially adapted to paint the horizontal top and bottom bars of a fence.

A drawback in such apparatus might be that when the vehicle approaches a dead-end barrier or an inside corner in the fence line, the apparatus might not be able to move close to the barrier or into the corner, thereby requiring manual finishing of the remaining unreachable section. In accordance with one aspect of this invention, the yoke portion of the overall apparatus can be made to yield forwardly or rearwardly up to such a barrier or corner.

BRIEF DESCRIPTION OF THE DRAWINGS

FIG. 1 is a perspective view of the independent sled-mounted apparatus according to this invention;

FIG. 2 is an end view of the apparatus shown in FIG. 1;

FIG. 3 is a further partial end view showing one of the paint roller assemblies; and FIG. 4 is a cross-sectional view, taken as indicated by lines 4—4 in FIG. 3.

DESCRIPTION OF THE PREFERRED EMBODIMENT

Referring to FIG. 1, there is illustrated a fence, generally indicated as F, and the apparatus according to this invention generally indicated as 2. Such a typical wire fence is made up of upper and lower horizontal tubular bars 4 and 6, respectively, and vertical posts 5. In many cases there is a framework 8 which strings barbed wire 10 in an oblique (or vertical) plane at an angle to the vertical.

Apparatus 2 has an integral framework comprising sets of adjustably telescoped outer steelwork members 12, and inner members 14 which carry a rigid, rectangular and cantilevered horizontal framework 16. A viable alternative, not shown, is to support the entire apparatus from an outrigger beam by means of springs, whereby the apparatus can float vertically.)

At the bottom ends of members 12, the entire apparatus is supported by and interacts with a long sled 18 in a manner to be described hereafter.

At the other side of a fence, framework 16 carries depending members 22 which are rigidly but adjustably connected thereto by pins or bolts 23 which fit into spaced holes 26 and 28 in the upper and lower horizontal frame members, respectively. Members 22 are adjustably telescoped into lower depending members 24.

In the preferred embodiments, the entire apparatus is dragged along by a motorized vehicle V, although it conceivably could be pushed or pulled along by manual or other means. Apparatus 2 in this case is coupled to the vehicle so that the apparatus can float laterally, toward and away from the vehicle, e.g., due to variations in the fence line or the driver's steering of the vehicle. Such objective is accomplished by means of resiliently yieldable struts comprising telescoping parts 26 and 28, the shaft 26 being connected to framework 16 by a pin 30. The vehicle V has mounted at its side a mast 34, braced by a strut 36, and cylinder 28 is pivotally connected to mast 34 by a pin 32. At the bottom of this structure, the vehicle drags the sled 18 through a tow rope, bar or the like, having a shock absorber, spring or other type of yielding means interposed to permit deviations in lateral distance from the fence line.

Sled 18 carries along its length a slotted guide channel 40, in which lugs 13 at the bottoms of members 14 are slidable. Wheels 20 enhance the smoothness of motion of the sled over the ground surface. At each end of the sled there is a bracket 41 which anchors one end of a spring 42. Opposed springs 42 are connected at their other ends to upright members 12. Normally the apparatus 2 will reside neutrally at the middle of the sled 18. However, when the apparatus encounters a barrier such as a corner as illustrated in FIG. 1, the rearward spring can be loosened or disconnected by appropriate means so that the apparatus can easily be pushed and/or pulled by the other spring toward the corner.

Inwardly extending spaced brackets 48 affixed to members 12 are pivotally connected to swinging levers 46 which are biased toward a central position by springs 47. Long paint rollers 54, of the typical nap construction, of the order of four to eight feet long (made up of composite sections), and four to five inches diameter, are mounted between levers 46. At the back side similar brackets carry pivotally movable levers 44, which likewise have paint rollers 52 mounted between them for free rotational movement. Rollers 52 and 54 are not actively driven, but derive their rotation from engagement with the fence as the apparatus travels. Paint or coating is applied to the rollers under pressure through tubes 54 which have spray orifices directed toward the rollers. The paint is supplied through hoses 60 that are connected to a mobile paint reservoir and compressor unit (not shown) of a well-known type. Each of the rollers 52, 54 is partially covered by a semi-circular shroud 70 to protect adjacent areas from scattered paint. (Spray from tubes 38 is directed toward exposed portions of the rollers that are not shielded by the shrouds.)

In conjunction with the long paint rollers 52, 54, there are special sets of smaller rollers 62, 63, 64, which are specially adapted to painting of the upper horizontal bar 4 of the fence. Another similar set, 66, 67, 68, is adapted to paint the lower fence bar 6.

Another significant feature of this invention is two sets of rollers 74 rotably mounted in yokes 75 which are angularly free-floating by virtue of being carried by articulated linkages 76 and 78. Rollers 74 are provided for the purpose of painting the upper barbed wire 10, whether its supporting brackets 8 slant inwardly, outwardly or substantially vertically. Paint is supplied through hoses 60 in the same manner the other rollers in the systems.

The half of the roller assembly at the other side of the fence is easily removable simply by removing the pins 23. Thus the apparatus can be used to paint only one side of a wall or fence. In that case the rollers 74 and linkages also are removed.

If desired, a drip pan (not shown) can be provided to receive excess paint drippings from the paint rollers 52, 54. Under carefully adjusted paint supply conditions, however, it is contemplated that the pumping of paint will be metered to avoid a flow of paint in excess of that which will be fully absorbed in the painting process. Also if desired, such accumulated excess paint can be pumped back to a reservoir for recycling or for other side uses.

I claim:

1. Apparatus for applying a liquid coating to a substantially vertical surface comprising:

(a) a substantially U-shaped yoke inverted to straddle a fence or wall;

(b) means supporting said yoke on at least one side thereof for propelled movement adjacent a fence line;

(c) opposing liquid applicator means within sides of said yoke and adapted to act upon the respective opposite sides of said fence or wall; and (d) means mounting said liquid applicator means within said yoke for free floating lateral movement to adjust for deviations in relation to the vertical surface.

2. Apparatus according to claim 1, wherein said supporting means comprises an elongate sled structure, said yoke being connected to said sled structure and being vertically guided by the average positioning thereof.

3. Apparatus according to claim 2, wherein means connecting said structure to a propelled vehicle includes yieldable means for allowing the sled structure to move vertically and laterally with respect to said vehicle.

4. Apparatus according to claim 2 or 3, wherein the means for connecting said yoke to said sled structure includes means allowing relative forward and rearward movement between them.

5. Apparatus according to claim 4, wherein said yoke is longitudinally slidable along and upon said sled structure.

6. Apparatus according to claim 3, wherein said means for connecting said yoke to a vehicle includes a resilient support means permitting lateral and vertical following of the yoke according to the contour of the wall or fence.

7. Apparatus according to claim 1, including a separate pair of opposed liquid applicator means at the top of said yoke adapted to paint an angular upper portion of a wall or fence, and means mounting said separate liquid applicator means with an angular adjustment to follow a different slant of the upper portion of a fence.

8. Apparatus according to claim 7, wherein said mounting means for said separate liquid applicator means comprises a toggle linkage shiftable between one side and the other of a fence having an extension slanted inwardly or outwardly at its top.

9. Apparatus according to claim 1, wherein said opposing liquid applicator means comprise vertically oriented paint rollers, the means for mounting the rollers on said yoke comprising arms pivotally connected to said yoke and means biasing said arms toward each other against the opposite sides of a fence or wall.

10. Apparatus according to claim 9, wherein said arms are adapted to be swung forward or backward to accomodate a dragging movement relative to a fence in either of two directions.

11. Apparatus for applying a liquid coating to both sides of a substantially vertical surface at both sides thereof comprising:

(a) a substantially U-shaped yoke inverted to straddle a wall or fence;

(b) means resiliently guiding and mounting said yoke at the side of a self-propelled vehicle;

(c) at least one pair of vertical coating rollers mounted from opposite sides of said yoke;

(d) means resiliently biasing said rollers against each other and against opposite sides of a fence or wall structure; and (e) a sled movable along the ground surface adjacent the fence or wall at the vehicle side thereof, said yoke being supported upon and vertically shifting in accordance with the average orientation of said sled as it moves over the ground surface.

12. Apparatus according to claim 11, including a separate pair of opposed liquid coating rollers at the top of said yoke and mounted therefrom to receive between them both sides of an angular upper portion of a wall or fence, and means mounting said liquid coating rollers with adjustability to follow a different slant of the upper portion of a fence or wall.

13. Apparatus according to claim 11 or 12, including at least one smaller set of axially narrow coating rollers spindled on at least one end of said vertical coating rollers and particularly adapted to coat the horizontal bars of a fence.

14. Apparatus according to claim 11 or 12, including means for applying liquid coating to said coating rollers.

* * * * *